US005970671A

United States Patent [19]

Bifano et al.

[11] Patent Number: 5,970,671

[45] Date of Patent: Oct. 26, 1999

[54] CONSTRUCTION ACCESSORY

[75] Inventors: Gabriel F. Bifano, Miami; Erenio Reyes, Miramar, both of Fla.

[73] Assignee: Vinyl Corporation, Miami, Fla.

[21] Appl. No.: 09/059,806

[22] Filed: Apr. 14, 1998

[51] Int. Cl.[6] ..... E04B 1/00; E04B 2/00

[52] U.S. Cl. ..... 52/254; 52/446; 52/479; 52/209; 52/293.3; 52/781.3; 428/603

[58] Field of Search ..... 52/60, 254, 446, 52/302.1, 302.3, 293.3, 293.1, 265, 267, 209, 479, 781.3; 428/598, 603

[56] References Cited

U.S. PATENT DOCUMENTS

| | | | |
|---|---|---|---|
| 1,310,331 | 7/1919 | Ficklen . | |
| 2,073,185 | 3/1937 | Shafer | 52/293.3 |
| 2,483,888 | 10/1949 | Danielson | 52/254 X |
| 3,019,866 | 2/1962 | Grabowski | 403/4 |
| 3,332,180 | 7/1967 | Price | 52/60 X |
| 3,494,085 | 2/1970 | Van Bael . | |
| 3,509,674 | 5/1970 | Birum, Jr. | 52/302.1 |
| 4,059,936 | 11/1977 | Lukens . | |
| 4,624,087 | 11/1986 | Schneller . | |
| 4,722,153 | 2/1988 | Hardy | 52/254 X |
| 4,752,517 | 6/1988 | Beitel . | |
| 4,936,069 | 6/1990 | Hunter et al. | 52/733.4 X |
| 5,003,743 | 4/1991 | Bifano et al. . | |
| 5,022,212 | 6/1991 | Lippolt | 52/254 X |
| 5,226,274 | 7/1993 | Sommerstein . | |
| 5,272,846 | 12/1993 | Kelley et al. . | |
| 5,397,201 | 3/1995 | Novak et al. . | |
| 5,414,965 | 5/1995 | Kelley et al. | 52/60 |
| 5,433,986 | 7/1995 | Moscatello . | |
| 5,519,969 | 5/1996 | Golba | 52/60 |
| 5,531,050 | 7/1996 | Stibolt et al. | 52/254 |
| 5,729,939 | 3/1998 | Di Benedetto | 52/293.3 |
| 5,784,838 | 7/1998 | Phillips | 52/302.1 X |

OTHER PUBLICATIONS

"Vinyl Corp. Product Data" Catalog; copyright 1997.

"VinylTech Plastic Components, Inc."; Excerpts from Catalog; 8 pages.

*Primary Examiner*—Christopher T. Kent
*Assistant Examiner*—Brian E. Glessner
*Attorney, Agent, or Firm*—Foley & Lardner

[57] ABSTRACT

A construction accessory for use with a construction panel includes a flange having an inner surface adapted to face the construction panel and an outer surface opposite the inner surface. The flange further includes at least one perforation extending through the flange between the inner surface and the outer surface and a depression in the inner surface. The depression is in communication with said at least one perforation.

56 Claims, 2 Drawing Sheets

CONSTRUCTION ACCESSORY

RELATED CO-PENDING APPLICATION

The present application is related to co-pending U.S. patent application Ser. No. 09/059,743 by Gabriel F. Bifano and Erenio Reyes entitled "PANEL SUPPORT CONSTRUCTION ACCESSORY" filed on the same date herewith.

FIELD OF THE INVENTION

The present invention relates to construction accessories. In particular, the present invention relates to a construction accessory having a flange with a depression, such as an elongate channel, extending along its surface to facilitate fluid flow adjacent to the surface.

BACKGROUND OF THE INVENTION

Construction accessories come in a variety of different configurations, shapes and sizes, and serve a variety of different functions in both interior and exterior construction applications. Construction accessories have various uses such as supporting panels, supporting coatings of construction fluid materials, producing durable straight lines, smooth curves and arches, providing soffit ventilation, controlling expansion and contraction, and protecting comers and edges. Construction accessories further protect and preserve edges of construction panels, such as wallboard, from impact and condensation. Examples of construction accessories include corner beads, casing beads, control joints, expansion (slip) joints, channel reveals, soffit vents, shadow reveals, drip reveals, vented drip reveals, weep screeds, L-beads, J-beads, arc beads, panel edges and drip casing beads. The construction accessories are typically extruded or molded from a variety of different materials such as aluminum, zinc, galvanized steel, and various polymer and vinyl compounds.

Construction accessories typically include at least one flange which is configured to extend adjacent to a construction panel or substrate. Many construction accessories are additionally intended for use with construction fluid materials such as stucco, plaster, finishing compounds and polymer or cement-based matrixes. The flanges of such construction accessories are typically manufactured with perforations or apertures extending through the flange to allow the construction fluid materials to flow through the apertures and bond or anchor to the construction panel or substrate. However, because the flange often abuts the substrate, the construction fluid material does not adequately flow between the flange and the construction panel or substrate. As a result, the amount of construction fluid material between the flange and the substrate is insufficient to properly bond to the substrate. Consequently, the construction fluid material cracks upon drying and hardening.

This problem is exacerbated when the flange is made out of a vinyl compound such as polyvinylchloride and when the construction fluid material is relatively thin such as with cement matrixes including high quantities of the acrylic modifiers. Construction accessories formed from vinyl compounds such as polyvinylchloride (PVC) are generally preferred over construction accessories formed from other materials such as zinc, aluminum or galvanized steel due to several factors such as the durability, corrosion resistance, solid color, paint adhesion properties, ignition resistance, electrical conductivity, impact resistance, and expansion and contraction characteristics. Moreover, construction accessories formed from vinyl compounds are generally less expensive as compared to equivalent products manufactured in galvanized steel, zinc or aluminum. However, forming adequate bonds to construction accessories formed from vinyl compounds is extremely difficult. As a result, some construction accessories formed from vinyl compounds have been provided with striations. These striations have a V-shaped cross-section and are conventionally formed in surfaces of the construction accessories facing away from the construction panel or substrate. Each striation has converging side surfaces which are spaced apart from one another slightly less than 1/16 of a inch at the top of the V-shaped cross-section. Despite the purported advantages of striations, such striations do not effectively increase the bonding of cement modified construction fluid materials to construction accessories formed from vinyl compounds.

SUMMARY OF THE INVENTION

The present invention is directed to a construction accessory for use with a construction panel. The accessory includes a flange having an inner surface adapted to face the construction panel and an outer surface opposite the inner surface. The flange further includes at least one perforation extending through the flange between the inner surface and the outer surface and a first depression in the inner surface. The first depression is in communication with said at least one perforation.

According to one aspect of the present invention, the construction accessory is configured for use with construction fluid materials. The first depression is sized to permit flow of construction fluid materials therewithin. Preferably, the first depression has a bottom with a depth of at least about 1/64 of an inch and a width of at least about 1/16 of an inch. The first depression preferably has a rectangular cross section.

According to other aspects of the present invention, the accessory includes a second depression in the outer surface. Preferably, the first depression comprises an elongate channel extending along the length of the flange. Preferably, the accessory includes a plurality of perforations, wherein the first depression interconnects the perforations.

According to yet another aspect of the present invention, the accessory comprises a panel support. The panel support includes a second flange obliquely extending from the first flange and a third flange obliquely extending from the second flange. The first flange, the second flange and the third flange form a channel or cavity sized to receive the construction panel. The first flange preferably includes a ridge obliquely extending from the first flange and spaced from the second flange.

The present invention is further directed to a construction accessory for use with a construction panel and construction fluid materials. The construction accessory includes a flange having a length, an inner surface adapted to face the construction panel and an outer surface opposite the inner surface. The flange includes a first elongate channel extending along the length of the flange in the inner surface. The first channel is sized to facilitate flow of construction fluid materials within the first channel.

According to one aspect of the present invention, the construction accessory includes perforations extending between the inner surface and the outer surface. The perforations preferably communicate with the first elongate channel. In the preferred embodiment illustrated, the accessory includes a second elongate channel extending in the outer surface. Preferably, the construction accessory comprises a support panel having a second flange obliquely extending from the first flange and a third flange obliquely extending from the second flange. The first flange, the second flange and the third flange form a channel or cavity sized to receive a panel.

The present invention is also directed to a construction accessory for use with a construction panel. The construction accessory includes a flange having an inner surface adapted to face the construction panel and an outer surface opposite the inner surface. The flange includes a first elongate channel extending along the length of the flange in at least one of the inner surface and the outer surface. The first elongate channel has a rectangular cross-section.

The present invention is also directed to a construction support panel including a back flange, a bottom flange obliquely extending from the back flange and a front flange obliquely extending from the bottom flange. The back flange, the bottom flange and the front flange form a cavity sized to receive a panel. The front flange has a length, an inner surface adapted to face the construction panel and an outer surface. The front flange includes a plurality of perforations extending between the inner surface and the outer surface, and an elongate channel extending in the inner surface. The elongate channel extends along the length of the flange.

DETAILED DESCRIPTION OF THE PREFERRED EMBODIMENT

Figure 1:
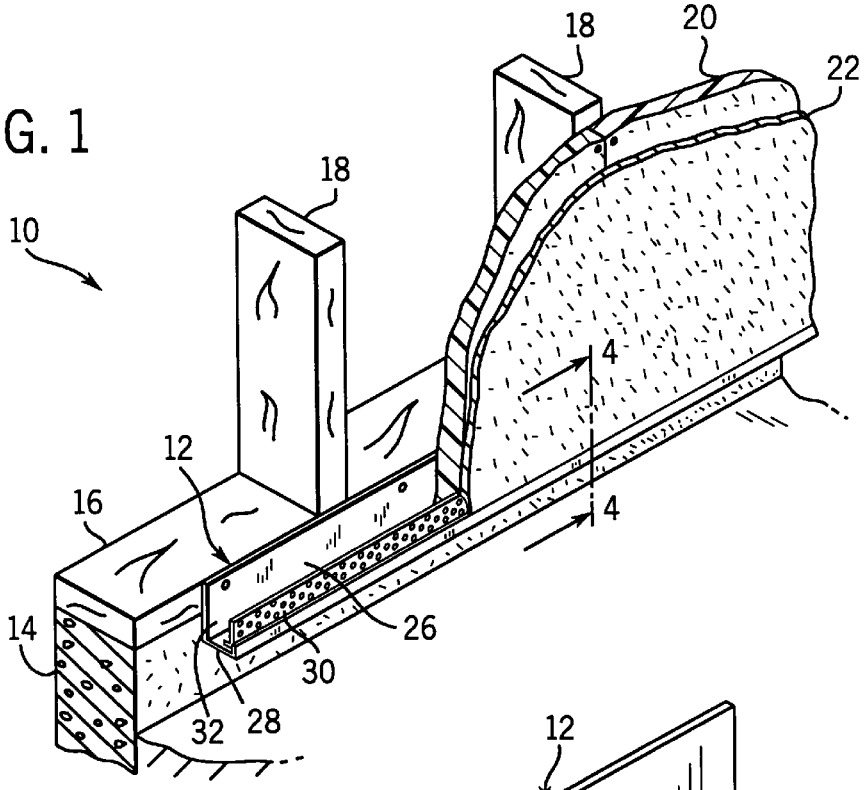
FIG. 1 is a fragmentary perspective view of a structure including a construction accessory of the present invention.

FIG. 1 is a fragmentary perspective view illustrating a structure 10 including the construction accessory 12. Structure 10 generally includes foundation 14, structural members 16, 18, accessory 12, construction panels 20, and coating 22. Structural member 16 generally comprises a conventionally known two-by-four board bolted or otherwise coupled to foundation 14 which serves as a base for structure 10. Structural members 18 comprise conventionally known two-by-four studs which are generally fastened to the base provided by member 16 at 16- or 24-inch centers which extend vertically upward from structural member 16.

In the exemplary structure 10, construction accessory 12 comprises a panel support which generally includes a back flange 26, a bottom flange 28 and a reinforcement or front flange 30. Back flange 26 is coupled to structural support member 16 and extends adjacent structural support member 16 and foundation 14. Alternatively, back flange 26 may be coupled to an intermediate layer or layers of sheeting which are coupled to structural support members 16 and 18. Back flange 26, support flange 28 and front flange 30 extend relative to one another to define an elongate cavity or channel 32 that receives and supports construction panels 20. In addition to forming channel 32, front flange 30 supports coating 22 and facilitates the bonding of coating 22 to construction panels 20. As a result, coating 22 is less likely to crack upon drying.

Construction panels 20 are generally elongate flat sheets formed from any one of a variety of construction materials which are mounted to structural support members 16 and 18 and which have lower ends supported within channel 32 of construction accessories 12. Coating 22 is initially applied in fluid form and is coated over front flange 30 of construction accessory 12 against construction panels 20. Coating 22 comprises any one of a variety of construction fluid materials such as stucco, plaster, or various other finishing compounds such as cement matrixes including large quantities of acrylic modifiers. Coating 22 encapsules front flange 30 and bonds to construction panels 20. Upon drying, coating 22 preferably provides a smooth and solid finished surface capable of being painted, if desired.

Figure 2:
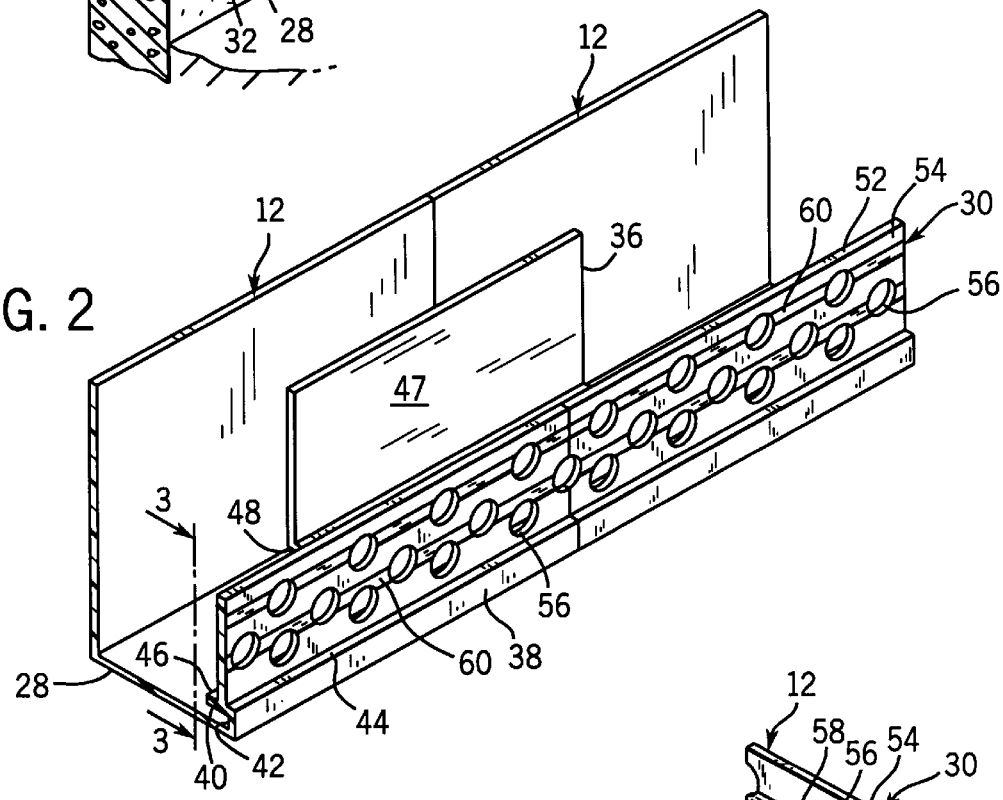
FIG. 2 is a perspective view illustrating two side-by-side construction accessories of the present invention joined by splice.
Figure 3:
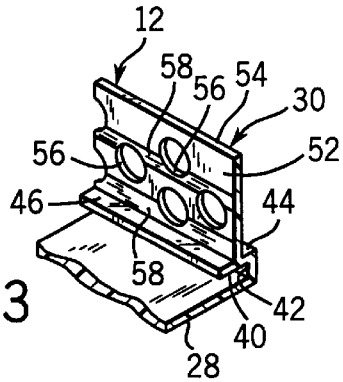
FIG. 3 is a fragmentary perspective view of the construction accessory of FIG. 2.

FIGS. 2 and 3 illustrate construction accessory 12 in greater detail. FIG. 2 is a perspective view illustrating two side-by-side construction accessories 12 braced by splice 36. FIG. 3 is a fragmentary rear perspective view of construction accessory 12. As best shown by FIG. 2, front flange 30 of accessory 12 obliquely extends from bottom flange 28 opposite back flange 26. Front flange 30 extends from bottom flange 28 parallel to back flange 26 such that channel 32 has a generally square or rectangular cross-sectional area.

As further shown by FIGS. 2 and 3, construction accessory 12 additionally includes side flange 38 and support flange 40. Side flange 38 extends from bottom flange 28 opposite back flange 26 and below front flange 30. Support flange 40 obliquely extends from side flange 38 towards back flange 26 and above bottom flange 28 to form splice channel 42. Splice channel 42 is defined by bottom flange 28, side flange 38 and support flange 40. Splice channel 42 is sized for receiving splice 36. Support flange 40 further provides shoulder 44 and ridge 46. Shoulder 44 inwardly extends from side flange 38 towards back flange 26. Shoulder 44 terminates at front flange 30. Shoulder 44 supports coating 22 adjacent to front flange 30.

Ridge 46 extends above splice channel 42 from front flange 30 towards back flange 26. Ridge 46 preferably extends non-parallel from front flange 30 at an angle of about 90°. Ridge 46 is preferably sized for supporting and elevating construction panels 20 above bottom flange 28. Side flange 38 and support flange 40 also elevate front flange 30 above bottom flange 28.

Splice 36 overlaps and extends between adjacent side-by-side construction accessories 12. Splice 36 is generally described in U.S. Pat. No. 5,003,743 (hereby incorporated by reference). Splice 36 has a generally L-shaped cross section that includes a first leg 47 configured for being positioned adjacent back flanges 26 and a second leg 48 configured for being positioned adjacent bottom flange 28 within splice channel 42. Splice 36 braces and reinforces the joint between two adjacent side-by-side construction accessories 12.

Front flange 30 obliquely extends relative to bottom flange 28 and support flange 40. Front flange 30 perpendicularly extends from support flange 40 away from bottom flange 28 between shoulder 44 and ridge 46. Front flange 30 generally includes inner surface 52, outer surface 54, perforations 56 and depressions 58, 60. Inner surface 52 obliquely extends from ridge 46 and faces back flange 26. Outer surface 54 extends from shoulder 44 and faces away from back flange 26. Perforations 56 extend through front flange 30 between inner surface 52 and outer surface 54.

Perforations 56 are preferably located and sized such that coating 22 (shown in FIG. 1) flows through perforations 56 and contacts construction panels 20 to bond to construction panels 20 as well as front flange 30. In the exemplary embodiment, perforations 56 have a diameter of about 0.25 inches. As can be appreciated, the location as well as the size of perforations 56 will vary depending upon type of construction fluid material used for coating 22, the material of construction panels 20 and the material from which construction accessory 12 is formed.

Depressions 58 comprise recesses or cavities which partially extend into inner surface 52 towards outer surface 54. Depressions 58 preferably comprise elongate channels formed in inner surface 52 which extend along substantially the entire axial length of front flange 30 to facilitate flow of construction fluid material along the axial length of front flange 30. Depressions 58 preferably communicate with at least one perforation 56 such that construction fluid material flowing through the perforation 56 further flows through and within depressions 58. In the exemplary embodiment, depressions 58 extend between and interconnect perforations 56 to facilitate the flow of construction fluid material between perforations 56. Each depression 58 preferably has a generally rectangular cross-section with a bottom 62 and side walls 64. Because depressions 58 have generally rectangular cross-sections, depressions 58 do not weaken the structural strength of front flange 30 as do conventional striations. In fact, it has been found that because depressions 58 preferably have a generally rectangular cross-section, the side walls 64, perpendicularly extending relative to the bottom 62 of each depression 58, actually rigidify and strengthen front flange 30. Bottom 62 of each depression 58 preferably has a depth of at least about 1/64 of an inch and a width of at least about 1/16 of an inch to facilitate flow of construction fluid material therewithin. In the embodiment illustrated, bottom 62 of depressions 58 has a width of about 1/8 of an inch. Increasing the width of bottom 62 increases the flow of construction fluid material along the axial length of front flange 30. This minimal depth and width for bottom 62 of depressions 58 has been found to be sufficient when construction accessory 12 is used with relatively thin cement modified construction fluid materials, such as cement matrixes with large quantities of acrylic modifiers. Of course, the minimal depth and width of depressions 58 will vary to a large extent depending upon the thickness and flow characteristics of the construction fluid material used with construction accessory 12.

Depressions 60 partially extend into outer surface 54 towards inner surface 52 of front flange 30. Depressions 60 are substantially identical to depressions 58. As with depressions 58, depressions 60 preferably comprise elongate channels that extend along substantially the entire axial length of front flange 30. Depressions 60 are preferably dimensioned to facilitate the flow of construction fluid materials therewithin. Depressions 60 preferably communicate with at least one perforation 56 and preferably interconnect multiple perforations 56. In addition to facilitating the flow of construction fluid material therewithin, depressions 58 and 60 further increase the overall surface area of inner surface 52 and outer surface 54 for bonding with the construction fluid material.

Although less desirable, depressions 58 and 60 may alternatively comprise various other configured depressions other than elongate channels extending into either or both of inner surface 52 and outer surface 54. For example, depressions 58 or 60 may alternatively comprise recessed dimples extending into either inner surface 52 or outer surface 54. Depressions 58, 60 may alternatively communicate with only a single perforation 56 in lieu of communicating between two or more perforations 56. Moreover, depressions 58, 60 may alternatively extend in various directions along front flange 30 in lieu of extending substantially along the entire axial length of front flange 30.

Construction accessory 12 is preferably extruded from a virgin vinyl compound. When intended for exterior use, accessory 12 is preferably extruded from weatherable grade, lead-free polyvinylchloride. Construction accessory 12 alternatively may be formed from various other polymer or vinyl compounds, polymer based or polymer modified materials, aluminum, galvanized steel or other metals. Moreover, in lieu of being integrally formed as part of a single unitary body, construction accessory 12 may be formed using distinct prefabricated components which are glued, welded, fastened, releasably interlocked or otherwise affixed to one another to form construction accessory 12. For example, front flange 30 may be separately manufactured and configured for being welded, fastened, releasably interlocked or otherwise affixed to support flange 40. Back flange 26, bottom flange 28, front flange 30, side flange 38 and support flange 40 preferably have a thickness of about 1/16 of an inch. As can be appreciated, the thicknesses of each of flanges 26, 28, 30, 38 and 40 will independently vary depending upon construction application. Perforations 56 are preferably drilled or punched into flange 30. Depressions 58 and 60 are preferably extruded within front flange 30. Alternatively, perforations 56 as well as depressions 58 and 60 may be formed by various other manufacturing techniques.

Figure 4:
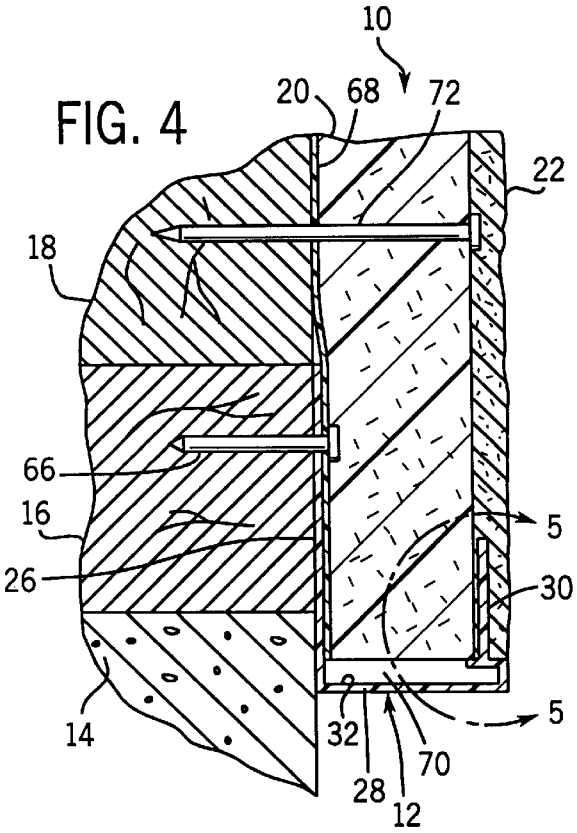
FIG. 4 is a sectional view of the structure of FIG. 1 taken along lines 4—4.
Figure 5:
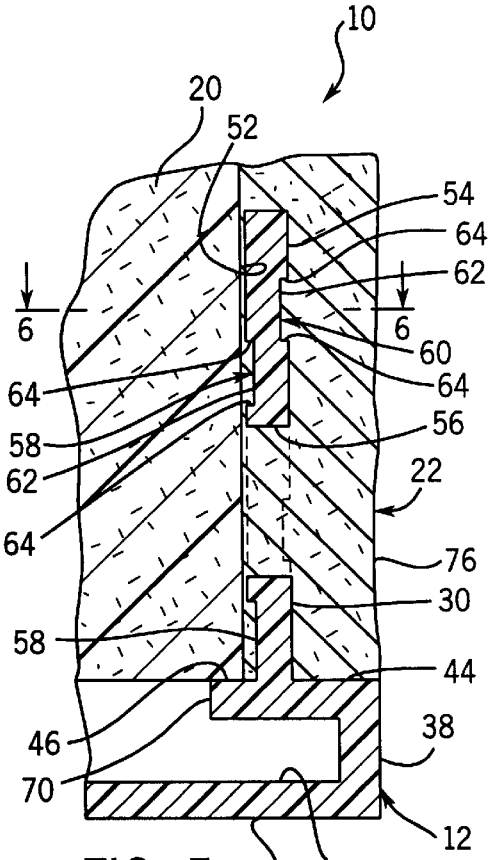
FIG. 5 is an enlarged view of the structure of FIG. 3 taken along lines 5—5.
Figure 6:
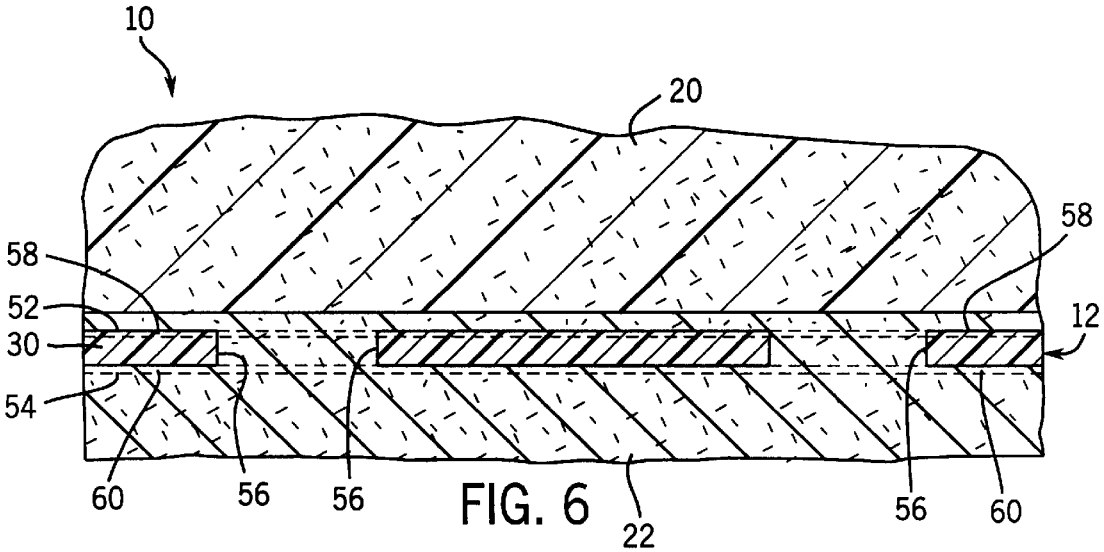
FIG. 6 is a sectional view of the structure of FIG. 4 taken along lines 6—6.

FIGS. 3 through 5 illustrate construction accessory 12 employed in structure 10 in greater detail. FIG. 3 is a sectional view of structure 10 taken along lines 3—3 of FIG. 1. FIG. 4 is an enlarged view of FIG. 3 taken along lines 4—4. FIG. 5 is a sectional view of structure 10 taken along lines 5—5 of FIG. 5. As best shown by FIG. 3, construction accessory 12 is fastened to structural support members 16 via a nail 66 extending through back flange 26. A moisture barrier sheet 68 is additionally positioned adjacent and over back flange 26 and between structural support members 16 and 18 and construction panels 20. Construction panels 20 are located within channel 32 of construction accessory 12 and are elevated by ridge 46 to create space 70 in a lower end of channel 32 between bottom flange 28 and the bottom of construction panels 20. Space 70 provides a location for moisture to accumulate and expand to prevent deformation of construction accessory 12 caused by ice. As further shown by FIG. 3, construction panels 20 are additionally fastened to structural supports 18 by nails 72. Although not illustrated, construction panels 20 may further be secured to front flange 30 by nails, screws or other fasteners extending through perforations within front flange 30 into construction panels 20.

As best shown by FIGS. 4 and 5, coating 22, comprising a construction fluid material, is coated and applied above shoulder 44 over front flange 30 and construction panels 20. Coating 22 is preferably applied above shoulder 44 and over front flange 30 and construction panels 20 so as to form a frontal surface 76 which is contiguous with a front surface of side flange 38. As a result, side flange 38 provides a smooth and durable lower front surface contiguous with surface 76 of coating 22. Side flange 38 and bottom flange 28 also provide a smooth and impact resistant corner to the front face of structure 10. This corner as well as the front surfaces of side flange 38 and coating 22 may be painted, further finished or left in a natural state.

As further shown by FIGS. 4 and 5, as coating 22 is applied over outer surface 54 of front flange 30, coating 22 flows through perforations 56 to contact construction panel 20. Because depressions 58 in inner surface 52 of front flange 30 communicate with perforations 56, coating 22 further flows into depressions 58 between inner surface 52 of front flange 30 and construction panel 20. Because depression 58 extends substantially along the entire length of front flange 30, coating 22 flows substantially along the entire axial length of front flange 30 between front flange 30 and construction panel 20. Because depression 58 communicates between multiple perforations 56, coating 22 flows within depression 58 from multiple inlet locations to further facilitate the flow of coating 22 between front flange 30 and construction panel 20. This increased flow of coating 22 between front flange 30 and construction panel 20 increases the amount of coating 22 between front flange 30 and construction panel 20 to create a strong bond between coating 22 and construction panel 20. Moreover, the increased amount of coating 22 between front flange 30 and construction panel 20 further strengthens the joint between adjacent construction accessories 12. The flow space provided by depressions 58 is especially beneficial when there is little space between construction panel 20 and inner surface 52 of front flange 30 or when coating 22 is relatively thin such as with a cement matrix including large quantities of acrylic modifiers.

Although front flange 30 including perforations 56 and depressions 58, 60 is illustrated as part of the panel support, flange 30 may be utilized in a variety of other construction accessories configured for use with construction fluid materials. For example, flange 30 may alternatively be utilized in corner beads, casing beads, control joints, expansion or slip joints, channel reveals, reveal intersections, soffit vents, shadow reveals, drip reveals, weep screeds and other miscellaneous construction accessories used in exterior and interior finishing systems. Moreover, flange 30 may also be utilized in other construction accessories for providing ventilation along the inner or outer surface of flange to discharge moisture from within a structure. Overall, front flange 30 improves the overall quality of construction.

Although the present invention has been described with reference to preferred embodiments, workers skilled in the art will recognize that changes may be made in form and detail without departing from the spirit and scope of the invention. The present invention described with reference to the preferred embodiments and set forth in the following claims is manifestly intended to be as broad as possible. For example, unless specifically otherwise noted, the claims reciting a single particular element also encompass a plurality of such particular elements.

What is claimed is:

1. A construction accessory for use with a construction panel, the accessory comprising:

first flange having an inner surface adapted to face the construction panel and an outer surface opposite the inner surface, the first flange including at least one perforation extending through the flange between the inner surface and the outer surface; and a first depression in the Inner surface, wherein the depression is in communication with said at least one perforation, wherein the construction accessory is configured for use with construction fluid materials and wherein the first depression is sized to permit flow of construction fluid materials therewithin.

2. The accessory of claim 1, wherein the first depression has a depth of at least 1/64 of an inch.

3. The accessory of claim 1, wherein the first depression has a bottom with a width of at least 1/16 of an inch.

4. The accessory of claim 1, wherein the first depression has a bottom width of at least 1/16 of an inch and a depth of at least 1/64 of an inch.

5. The accessory of claim 1, wherein the first depression has a substantially rectangular cross-section.

6. The accessory of claim 1, including a second depression in the outer surface.

7. The accessory of claim 6, wherein the second depression has a substantially rectangular cross section.

8. The accessory of claim 1, wherein the depression comprises an elongate channel.

9. The accessory of claim 1, wherein the accessory has a length and wherein the first depression comprises an elongate channel extending along the entire length.

10. The accessory of claim 1, including a plurality of perforations, wherein the first depression interconnects the perforations.

11. The accessory of claim 1, wherein the accessory comprises a panel support and includes:

a second flange extending non-parallel from the first flange; and a third flange extending non-parallel from the second flange, wherein the first flange, the second flange and the third flange form a channel sized to receive the construction panel.

12. The accessory of claim 11, wherein the first flange includes a ridge extending non-parallel from the first flange and spaced from the second flange.

13. The construction accessory of claim 1, wherein the flange is made from a nonmetallic compound.

14. The construction accessory of claim 13, wherein the construction accessory is made from polyvinylchloride.

15. The accessory of claim 1 including a plurality of depressions in the inner surface, wherein the plurality of depressions are in communication with said at least one perforation.

16. The accessory of claim 8 including a plurality of elongate channels in the inner surface, wherein the plurality of elongate channels are in communication with said at least one perforation.

17. A construction accessory for use with a construction panel and construction fluids, the accessory comprising:

a first flange having a length, an inner surface adapted to face the construction panel and to extend opposite the construction panel and an outer surface opposite the inner surface, the flange including a first plurality of elongate channels extending along the length of the flange in the inner surface, each of the first plurality of channels being sized to facilitate flow of construction fluids and a second plurality of elongate channels extending in the outer surface.

18. The accessory of claim 17, including at least one perforation extending between the inner surface and the outer surface.

19. The accessory of claim 18, including a plurality of perforations having a first perforation communicating with a first one of the first plurality of channels and a second perforation communicating with a second one of the first plurality of channels.

20. The accessory of claim 17, wherein each of the first plurality of channels has a bottom with a width of at least 1/16 of an inch and a depth of at least 1/64 of an inch.

21. The accessory of claim 17, wherein each of the first plurality of channels has a rectangular cross section.

22. The accessory of claim 17, wherein the accessory comprises a panel support and includes:

a second flange extending non-parallel from the first flange;

a third flange extending non-parallel from the second flange, wherein the first flange, the second flange and the third flange form a cavity sized to receive the construction panel; and at least one ridge extending above the second flange and configured to extend below the construction panel and to support the construction panel above the second flange, wherein the plurality of channels extend above the at least one ridge.

23. The accessory of claim 17 including a plurality of elongate channels extending along the length of the flange in the inner surface, each of the plurality of the elongate channels being sized to facilitate flow of construction fluids within the channel.

24. A construction structure comprising:

a construction panel;

a first flange having an inner surface opposite the construction panel facing the construction panel and an outer surface opposite the inner surface;

a plurality of elongate channels extending along the length of the first flange in at least one of the inner surface and the outer surface, each of the plurality of channels having a generally rectangular cross-section.

25. The construction accessory of claim 24, including at least one perforation extending between the inner surface and the outer surface.

26. The construction accessory of claim 24 wherein the first elongate channel has a bottom with a width of at least 1/16 of an inch and a depth of at least 1/64 of an inch.

27. The construction accessory of claim 24 including a plurality of elongate channels extending the length of the flange in at least one of the inner surface and the outer surface, wherein each of the plurality of elongate channels has a generally rectangular cross-section.

28. The construction structure of claim 24 further including:

a second flange extending non-parallel from the first flange; and a third flange extending non-parallel from the second flange, wherein the first flange, the second flange and the third flange form a channel in which the construction panel is at least partially received.

29. The construction structure of claim 28 wherein the third flange perpendicularly extends from the second flange.

30. The construction structure of claim 29 wherein the second flange perpendicularly extends from the first flange.

31. The construction structure of claim 28 wherein the plurality of elongate channels includes a first elongate channel extending in the inner surface and a second elongate channel extending within the outer surface.

32. The construction structure of claim 31 including at least one perforation extending through the first flange and communicating with both the first elongate channel and the second elongate channel.

33. The construction structure of claim 32 including a plurality of elongate channels extending along the length of the first flange in the inner surface.

34. The construction structure of claim 33 including a plurality of elongate channels extending along the length of the first flange in the outer surface.

35. The construction structure of claim 34 including at least one ridge extending above the second flange and supporting the construction panel above the second flange, wherein the plurality of channels extending in the inner surface of the first flange and the plurality of channels extending in the outer surface of the first flange extend above the at least one ridge.

36. The construction structure of claim 34 wherein each of the plurality of channels in the inner surface of the first flange has a rectangular cross section and wherein each of the plurality of channels in the outer surface of the first flange has a rectangular cross section.

37. The construction structure of claim 34 including a shoulder extending adjacent the outer surface of the first flange and below the plurality of channels extending in the outer surface of the first flange.

38. The construction structure of claim 28 including at least one structural support member, wherein the third flange is mounted to the at least one structural support member.

39. The construction structure of claim 38 including a coating extending adjacent the inner surface and the outer surface of the first flange and through the at least one perforation.

40. A construction panel support for use with a construction panel, the construction panel support comprising:

a back flange;

a bottom flange extending non-parallel from the back flange; and a front flange extending non-parallel from the bottom flange, wherein the back flange, the bottom flange and the front flange form a cavity sized to receive a construction panel, wherein the front flange has an inner surface facing the back flange and adapted to face the panel, an outer surface opposite the inner surface and a plurality of perforations extending between the inner surface and the outer surface, and wherein the inner surface includes a plurality of elongate channels, each of the plurality of channels communicating with at least one of the plurality of perforations.

41. A construction accessory for use with a construction panel and construction fluids, the accessory comprising:

a first flange;

a second flange extending non-parallel from the first flange; and a third flange extending non-parallel from the first flange, the third flange having a length, an inner surface adapted to face the construction panel and to extend opposite the construction panel and an outer surface opposite the inner surface, wherein the first flange, the second flange and the third flange form a cavity sized to receive the construction panel; and at least one ridge extending above the first flange and configured to extend below the construction panel and to support the construction panel above the first flange, wherein the third flange includes a first plurality of elongate channels extending in the inner surface above the at least one ridge.

42. The construction accessory of claim 41 including a second plurality of elongate channels extending along the third flange in the outer surface above the at least one ridge.

43. The construction accessory of claim 41 including a plurality of perforations extending through the third flange from the outer surface to the inner surface, wherein at least one perforation communicates with each of the plurality of channels.

44. A construction structure comprising:

a construction panel;

a first flange having an inner surface facing the construction panel and an outer surface opposite the inner surface, the first flange Including at least one perforation extending through the first flange between the inner surface and the outer surface;

a first depression in the inner surface, wherein the first depression is in communication with said at least one perforation; and a coating adjacent the outer surface and extending through the at least one perforation.

45. The construction structure of claim 44 wherein the first flange includes first and second opposite edges peripherally about the at least one perforation and wherein the coating extends from the first opposite edge to the second opposite edge.

46. The construction structure of claim 44 including:

a second flange extending non-parallel from the first flange; and a third flange extending non-parallel from the second flange, wherein the first flange, the second flange and the third flange form a channel in which the construction panel is at least partially disposed.

47. The construction structure of claim 46 including at least one ridge spaced from the second flange and spacing the construction panel from the second flange.

48. The construction structure of claim 47 including a shoulder adjacent the outer surface of the first flange between the first depression and the second flange.

49. The construction structure of claim 44 including a shoulder extending adjacent the outer surface of the first flange, wherein the coating extends adjacent to the shoulder.

50. The construction structure of claim 48 including a second depression In the inner surface.

51. The construction structure of claim 49 including a second depression In the outer surface.

52. The construction structure of claim 51 wherein the at least one perforation extends through the first flange and communicates with both the first depression and the second depression.

53. The construction structure of claim 44 wherein the first depression has a rectangular cross section.

54. The construction structure of claim 44 wherein the coating extends through the at least one perforation and at least partially within the first depression.

55. The construction structure of claim 44 wherein the coating comprises a construction fluid material selected from the group including: stucco, plaster and a cement matrix.

56. The construction structure of claim 44 wherein the first depression has a bottom with a width of at least 1/16 of an inch.

* * * * *